US007871020B2

(12) United States Patent
Nelson et al.

(10) Patent No.: US 7,871,020 B2
(45) Date of Patent: Jan. 18, 2011

(54) FAUCET SPRAY HEAD WITH VOLUME CONTROL

(75) Inventors: Alfred Charles Nelson, Carmel, IN (US); Derek Allen Brown, Lizton, IN (US)

(73) Assignee: Masco Corporation of Indiana, Indianapolis, IN (US)

( * ) Notice: Subject to any disclaimer, the term of this patent is extended or adjusted under 35 U.S.C. 154(b) by 258 days.

(21) Appl. No.: 11/698,666

(22) Filed: Jan. 26, 2007

(65) Prior Publication Data

US 2007/0170284 A1 Jul. 26, 2007

Related U.S. Application Data

(60) Provisional application No. 60/762,600, filed on Jan. 26, 2006.

(51) Int. Cl.

| | |
|---|---|
| ***A62C 31/00*** | (2006.01) |
| ***A62C 37/20*** | (2006.01) |
| ***B05B 1/30*** | (2006.01) |
| ***F15B 13/00*** | (2006.01) |
| ***E03C 1/04*** | (2006.01) |

(52) U.S. Cl. ..... 239/445; 239/443; 239/562; 239/581.1; 239/582.1; 137/801; 4/678

(58) Field of Classification Search ..... 239/443, 239/445, 449, 561, 562, 581.1, 581.2, 588; 137/801; 4/678

See application file for complete search history.

(56) References Cited

U.S. PATENT DOCUMENTS

| | | | |
|---|---|---|---|
| 603,144 | A | 4/1898 | Kellerman et al. |
| 1,123,189 | A | 12/1914 | Moore et al. |
| 1,647,983 | A | 11/1927 | Bloch |
| 2,314,071 | A | 3/1943 | Bucknell et al. |
| 2,416,747 | A | 3/1947 | Geimer |
| 2,566,878 | A | 9/1951 | Fahrenkrog et al. |
| 2,567,176 | A | 9/1951 | Ballard |
| 2,584,943 | A | 2/1952 | Thomas |
| 2,842,154 | A | 7/1958 | Lindsley |
| 2,956,579 | A | 10/1960 | Hannaford |
| 3,144,878 | A | 8/1964 | Williams |
| 3,341,132 | A | 9/1967 | Parkison |
| 3,524,591 | A | 8/1970 | Samuels et al. |
| 3,545,473 | A | 12/1970 | Moia |
| 3,588,040 | A | 6/1971 | Ward |
| 3,591,083 | A | 7/1971 | O'Rear |
| 3,656,503 | A | 4/1972 | Ward |
| 3,682,392 | A | 8/1972 | Kint |

(Continued)

FOREIGN PATENT DOCUMENTS

| | | |
|---|---|---|
| DE | 3306947 | 8/1984 |

(Continued)

*Primary Examiner*—Len Tran
*Assistant Examiner*—Ryan Reis
(74) *Attorney, Agent, or Firm*—Baker & Daniels LLP

(57) ABSTRACT

A faucet spray head having a volume control mechanism allowing the user to adjust the flow of water through the spray head from a full-spray to full-stream and to a paused flow and flow levels therebetween. The volume control mechanism illustratively includes a spring-activated safety mechanism that prevents the user from inadvertently leaving the faucet head in an off position, thereby preventing the mixing or backing up of hot water into the cold water supply.

35 Claims, 8 Drawing Sheets

U.S. PATENT DOCUMENTS

| | | | | |
|---|---|---|---|---|
| 3,698,644 | A | | 10/1972 | Nystuen |
| 3,722,525 | A | | 3/1973 | Epple |
| 3,768,735 | A | | 10/1973 | Ward |
| 3,786,995 | A | | 1/1974 | Manoogian et al. |
| 3,851,825 | A | | 12/1974 | Parkison et al. |
| 3,876,151 | A | | 4/1975 | Katva |
| 3,902,671 | A | | 9/1975 | Symmons |
| 3,944,141 | A | | 3/1976 | Siczek |
| 4,029,119 | A | | 6/1977 | Klieves |
| 4,119,276 | A | | 10/1978 | Nelson |
| 4,187,986 | A | * | 2/1980 | Petrovic ..... 239/449 |
| 4,221,337 | A | | 9/1980 | Shames et al. |
| 4,224,962 | A | | 9/1980 | Orszullok |
| 4,257,460 | A | | 3/1981 | Paranay et al. |
| 4,396,156 | A | | 8/1983 | Southworth et al. |
| 4,398,669 | A | | 8/1983 | Fienhold |
| 4,461,052 | A | | 7/1984 | Mostul |
| 4,524,911 | A | | 6/1985 | Rozniecki |
| 4,534,512 | A | * | 8/1985 | Chow et al. ..... 239/394 |
| 4,541,568 | A | | 9/1985 | Lichfield |
| 4,581,707 | A | | 4/1986 | Millar |
| 4,582,253 | A | | 4/1986 | Gerdes |
| 4,606,370 | A | | 8/1986 | Geipel et al. |
| 4,618,100 | A | | 10/1986 | White et al. |
| 4,619,403 | A | | 10/1986 | Goldney et al. |
| 4,629,124 | A | | 12/1986 | Gruber |
| 4,650,120 | A | | 3/1987 | Kress |
| 4,666,085 | A | | 5/1987 | Liaw |
| 4,696,322 | A | | 9/1987 | Knapp et al. |
| 4,703,893 | A | | 11/1987 | Gruber |
| 4,776,517 | A | | 10/1988 | Heren |
| 4,785,998 | A | | 11/1988 | Takagi |
| RE32,981 | E | | 7/1989 | Marty |
| 4,909,443 | A | | 3/1990 | Takagi |
| 4,927,115 | A | | 5/1990 | Bahroos et al. |
| 4,934,402 | A | | 6/1990 | Tarnay et al. |
| 4,955,546 | A | | 9/1990 | Liaw |
| 4,997,131 | A | | 3/1991 | Heren |
| 5,014,919 | A | | 5/1991 | Knapp |
| 5,052,587 | A | | 10/1991 | Graves |
| 5,069,241 | A | | 12/1991 | Hochstrasse |
| 5,093,943 | A | | 3/1992 | Wei |
| 5,100,055 | A | | 3/1992 | Rokitenetz et al. |
| 5,143,299 | A | | 9/1992 | Simonetti et al. |
| 5,145,114 | A | | 9/1992 | Monch |
| 5,158,234 | A | * | 10/1992 | Magnenat et al. ..... 239/449 |
| 5,160,092 | A | | 11/1992 | Rose et al. |
| 5,172,866 | A | | 12/1992 | Ward |
| 5,184,777 | A | | 2/1993 | Magnenat et al. |
| 5,201,468 | A | | 4/1993 | Freier et al. |
| 5,232,162 | A | | 8/1993 | Chih |
| 5,255,848 | A | | 10/1993 | Rhodehouse |
| 5,323,968 | A | | 6/1994 | Kingston et al. |
| 5,333,792 | A | | 8/1994 | Wang |
| 5,348,228 | A | | 9/1994 | Wang |
| 5,348,231 | A | | 9/1994 | Arnold et al. |
| 5,370,314 | A | | 12/1994 | Gebauer et al. |
| 5,383,604 | A | | 1/1995 | Boesch |
| 5,398,872 | A | | 3/1995 | Joubran |
| 5,433,384 | A | | 7/1995 | Chan et al. |
| 5,445,182 | A | | 8/1995 | Sturman et al. |
| 5,467,927 | A | | 11/1995 | Lee |
| 5,477,885 | A | | 12/1995 | Knapp |
| 5,507,314 | A | | 4/1996 | Knapp |
| 5,630,548 | A | | 5/1997 | Chih |
| 5,634,220 | A | | 6/1997 | Chiu |
| 5,647,537 | A | | 7/1997 | Bergmann |
| 5,649,562 | A | | 7/1997 | Sturman et al. |
| 5,662,273 | A | | 9/1997 | Chih |
| 5,662,276 | A | | 9/1997 | Ko |
| 5,669,558 | A | | 9/1997 | Ichel |
| 5,707,011 | A | | 1/1998 | Bosio |
| 5,722,597 | A | | 3/1998 | Guo |
| 5,732,884 | A | | 3/1998 | Jauner |
| 5,735,467 | A | | 4/1998 | Lee |
| 5,743,286 | A | | 4/1998 | Ko |
| 5,772,120 | A | | 6/1998 | Huber |
| 5,794,854 | A | | 8/1998 | Yie |
| 5,806,770 | A | | 9/1998 | Wang |
| 5,806,771 | A | | 9/1998 | Loschelder et al. |
| 5,813,435 | A | | 9/1998 | Knapp |
| 5,823,229 | A | | 10/1998 | Bertrand et al. |
| 5,829,681 | A | | 11/1998 | Hamel et al. |
| 5,853,130 | A | | 12/1998 | Ellsworth |
| 5,858,215 | A | | 1/1999 | Burchard et al. |
| 5,873,531 | A | | 2/1999 | Wang |
| 5,887,796 | A | | 3/1999 | Dimmer |
| 5,906,319 | A | | 5/1999 | Crowl |
| 5,918,816 | A | | 7/1999 | Huber |
| 5,927,333 | A | | 7/1999 | Grassberger |
| 5,937,905 | A | | 8/1999 | Santos |
| 5,944,141 | A | | 8/1999 | Kochan et al. |
| 5,971,299 | A | | 10/1999 | Loschelder et al. |
| 5,975,429 | A | | 11/1999 | Jezek |
| 5,975,432 | A | | 11/1999 | Han |
| 5,984,207 | A | | 11/1999 | Wang |
| 6,000,626 | A | | 12/1999 | Futo et al. |
| 6,000,637 | A | | 12/1999 | Duncan |
| 6,007,003 | A | | 12/1999 | Wang |
| 6,016,975 | A | | 1/2000 | Amaduzzi |
| 6,045,062 | A | | 4/2000 | Bosio |
| 6,059,200 | A | | 5/2000 | Chou |
| 6,076,743 | A | | 6/2000 | Fan |
| 6,085,790 | A | | 7/2000 | Humpert et al. |
| 6,129,294 | A | | 10/2000 | Hsin-Fa |
| 6,145,757 | A | | 11/2000 | Knapp |
| 6,151,729 | A | | 11/2000 | Yean |
| 6,158,152 | A | | 12/2000 | Nathenson et al. |
| 6,164,566 | A | | 12/2000 | Hui-Chen |
| 6,173,910 | B1 | | 1/2001 | Yean |
| 6,173,911 | B1 | | 1/2001 | Hui-Chen |
| 6,179,130 | B1 | * | 1/2001 | Nguyen et al. ..... 210/424 |
| 6,216,965 | B1 | | 4/2001 | Chao |
| 6,220,297 | B1 | | 4/2001 | Marty et al. |
| 6,230,989 | B1 | | 5/2001 | Haverstraw et al. |
| 6,234,192 | B1 | | 5/2001 | Esche et al. |
| 6,247,654 | B1 | | 6/2001 | Kuo |
| D445,874 | S | | 7/2001 | Czerwinski, Jr. et al. |
| 6,254,016 | B1 | | 7/2001 | Chao |
| 6,260,772 | B1 | | 7/2001 | Hennemann, Jr. et al. |
| 6,260,774 | B1 | | 7/2001 | Erickson |
| 6,290,147 | B1 | | 9/2001 | Bertrand |
| 6,296,011 | B1 | | 10/2001 | Esche et al. |
| 6,302,339 | B1 | | 10/2001 | Chou |
| 6,305,619 | B1 | | 10/2001 | Thurn |
| 6,341,738 | B1 | | 1/2002 | Coles |
| 6,367,710 | B2 | | 4/2002 | Fan |
| 6,367,711 | B1 | | 4/2002 | Benoist |
| 6,368,503 | B1 | | 4/2002 | Williamson et al. |
| 6,370,713 | B2 | | 4/2002 | Bosio |
| 6,382,529 | B1 | | 5/2002 | Wu |
| 6,415,958 | B1 | | 7/2002 | Donley |
| 6,427,931 | B1 | | 8/2002 | Guo |
| 6,431,468 | B1 | | 8/2002 | Brown et al. |
| 6,454,186 | B2 | | 9/2002 | Haverstraw et al. |
| 6,454,187 | B1 | | 9/2002 | Wang |
| 6,460,782 | B1 | | 10/2002 | Wang |
| 6,467,104 | B1 | | 10/2002 | Shieh |
| 6,471,141 | B2 | | 10/2002 | Smith et al. |
| 6,484,953 | B2 | | 11/2002 | Frier |
| 6,502,768 | B2 | | 1/2003 | Chang |
| 6,508,415 | B2 | | 1/2003 | Wang |
| 6,520,427 | B1 | | 2/2003 | Chen |
| 6,540,159 | B1 | | 4/2003 | Wang |

| | | | | |
|---|---|---|---|---|
| 6,540,163 | B1 | 4/2003 | Huang | |
| 6,561,210 | B2 | 5/2003 | Hsieh et al. | |
| 6,561,441 | B1 | 5/2003 | Hsieh | |
| 6,568,605 | B1 | 5/2003 | Chen | |
| 6,575,387 | B1 | 6/2003 | Baker | |
| 6,592,057 | B1 | 7/2003 | Ericksen et al. | |
| 6,595,440 | B2 * | 7/2003 | Moriarty et al. | 239/226 |
| 6,612,507 | B1 | 9/2003 | Meyer et al. | |
| 6,622,945 | B1 | 9/2003 | Wu | |
| 6,634,573 | B2 | 10/2003 | Bosch et al. | |
| 6,641,060 | B2 | 11/2003 | Bratolli et al. | |
| 6,641,061 | B1 | 11/2003 | Hsieh | |
| 6,644,333 | B2 | 11/2003 | Gloodt | |
| 6,659,373 | B1 | 12/2003 | Heren et al. | |
| 6,663,022 | B1 | 12/2003 | Baker | |
| 6,685,110 | B2 | 2/2004 | Wang et al. | |
| 6,691,933 | B1 | 2/2004 | Bosio | |
| 6,691,937 | B2 | 2/2004 | Heren et al. | |
| 6,719,219 | B1 | 4/2004 | Wang | |
| 6,738,996 | B1 | 5/2004 | Malek et al. | |
| 6,739,523 | B2 | 5/2004 | Haverstraw et al. | |
| 6,749,135 | B2 | 6/2004 | Groblebe et al. | |
| 6,757,921 | B2 | 7/2004 | Esche | |
| 6,796,515 | B2 | 9/2004 | Heren et al. | |
| 6,808,130 | B1 | 10/2004 | Ouyoung | |
| 6,808,131 | B2 | 10/2004 | Bosio | |
| 6,811,099 | B2 | 11/2004 | Krestine et al. | |
| 6,860,438 | B1 | 3/2005 | Huang | |
| 6,866,208 | B2 | 3/2005 | Kao | |
| 6,880,768 | B2 | 4/2005 | Lau | |
| 6,915,967 | B1 | 7/2005 | Chen | |
| 6,921,032 | B2 | 7/2005 | Habermacher et al. | |
| 6,945,474 | B1 | 9/2005 | Chen | |
| 6,962,298 | B1 * | 11/2005 | Martin | 239/447 |
| 6,981,661 | B1 | 1/2006 | Chen | |
| 7,000,626 | B1 | 2/2006 | Cress | |
| 7,000,854 | B2 | 2/2006 | Malek et al. | |
| 7,134,614 | B2 | 11/2006 | Miyake et al. | |
| 7,341,239 | B2 | 3/2008 | Hodel et al. | |
| 7,494,074 | B2 | 2/2009 | Benstead | |
| 2001/0020302 | A1 | 9/2001 | Bosio | |
| 2002/0185553 | A1 | 12/2002 | Benstead et al. | |
| 2002/0190141 | A1 | 12/2002 | Huang | |
| 2003/0042331 | A1 | 3/2003 | Lu | |
| 2003/0042337 | A1 | 3/2003 | Liang et al. | |
| 2003/0125842 | A1 | 7/2003 | Chang et al. | |
| 2003/0127541 | A1 | 7/2003 | Marino | |
| 2003/0173423 | A1 | 9/2003 | Haenlein et al. | |
| 2003/0189111 | A1 | 10/2003 | Heren et al. | |
| 2004/0010848 | A1 | 1/2004 | Esche | |
| 2004/0088786 | A1 | 5/2004 | Malek et al. | |
| 2004/0112985 | A1 | 6/2004 | Malek et al. | |
| 2004/0155460 | A1 | 8/2004 | Nobili | |
| 2004/0164183 | A1 | 8/2004 | Nobili | |
| 2004/0173688 | A1 | 9/2004 | Gloodt | |
| 2004/0222320 | A1 | 11/2004 | Wu | |
| 2004/0227014 | A1 | 11/2004 | Williams et al. | |
| 2005/0103897 | A1 | 5/2005 | Cannon et al. | |
| 2005/0121542 | A1 | 6/2005 | Su Lim | |
| 2005/0145554 | A1 | 7/2005 | Cunningham et al. | |
| 2005/0161533 | A1 | 7/2005 | Nobili | |
| 2005/0178857 | A1 | 8/2005 | Roman | |
| 2005/0178858 | A1 | 8/2005 | Roman | |
| 2005/0189438 | A1 | 9/2005 | Bosio | |
| 2005/0242210 | A1 | 11/2005 | Heren et al. | |
| 2006/0016912 | A1 | 1/2006 | Nobili | |
| 2006/0022071 | A1 | 2/2006 | Burnworth et al. | |
| 2006/0117477 | A1 | 6/2006 | Rosko | |
| 2006/0214016 | A1 | 9/2006 | Erdely et al. | |
| 2006/0255167 | A1 | 11/2006 | Vogel et al. | |
| 2007/0194148 | A1 | 8/2007 | Rosko et al. | |
| 2007/0221757 | A1 | 9/2007 | Malek et al. | |

FOREIGN PATENT DOCUMENTS

| | | |
|---|---|---|
| DE | 3643320 | 7/1988 |
| EP | 0 251 990 | 1/1988 |
| EP | 0 337 367 | 10/1989 |
| EP | 0 809 539 | 12/1997 |
| EP | 0 933 136 | 8/1999 |
| EP | 0 975 432 | 2/2000 |
| EP | 1 132 141 | 9/2001 |
| EP | 1 354 634 | 10/2003 |
| EP | 1 418 007 | 5/2004 |
| EP | 1 598 116 | 11/2005 |
| GB | 1452974 | 10/1976 |
| GB | 1 555 003 | 11/1979 |
| GB | 2 171 175 | 8/1986 |
| JP | 02-052061 | 2/1990 |
| JP | 10230192 | 9/1998 |
| JP | 11021956 | 1/1999 |
| JP | 2000027247 | 1/2000 |
| WO | WO 80/01940 | 9/1980 |
| WO | WO 86/06654 | 11/1986 |
| WO | WO 96/25237 | 8/1996 |
| WO | WO 98/46366 | 10/1998 |
| WO | WO 00/32314 | 6/2000 |
| WO | WO 2004/104305 | 12/2004 |
| WO | WO 2005/018814 | 3/2005 |
| WO | WO 2005/115554 | 12/2005 |

* cited by examiner

FAUCET SPRAY HEAD WITH VOLUME CONTROL

CROSS-REFERENCE TO RELATED APPLICATIONS

This application claims priority to U.S. Provisional Application Ser. No. 60/762,600, filed Jan. 26, 2006, which is expressly incorporated by reference herein.

BACKGROUND AND SUMMARY OF THE INVENTION

The present invention relates to faucet spray heads and, more particularly, to faucet spray heads that are extendable from a faucet neck, or delivery spout.

The present disclosure provides a faucet spray head having a volume control allowing the user to adjust the flow of water through the spray head between various modes and flow rates, including a full-spray mode, a full-stream mode, a paused flow mode, and flow levels therebetween. The volume control is illustratively designed to prevent the user from inadvertently leaving the spray head in an off position, thereby avoiding the mixing or backing up of hot water into the cold water supply.

According to an illustrative embodiment of the present disclosure, a faucet includes a delivery spout and a pull-out spray head removably coupled to the delivery spout. The spray head include a valve housing having an inlet, an outlet, and a compartment positioned intermediate, and in fluid communication with, the inlet and the outlet. A volume control is movably supported within the compartment for providing continuous variable adjustment of fluid flow rate between the inlet and the outlet from a low flow to a high flow.

According to a further illustrative embodiment of the present disclosure, a spray head for use with a faucet includes a housing having an inlet, a first outlet, and a second outlet. Fluid flow through the first outlet defines a first mode of operation, and fluid flow through the second outlet defines a second mode of operation. A control interface is supported by the housing wherein the same actuation of the control interface selects both the mode of operation and the rate of fluid flow through at least one of the first and second outlets.

According to yet another illustrative embodiment of the present disclosure, a spray head for use with a faucet includes a housing having an inlet, at least one outlet, and a compartment in fluid communication with the inlet and the at least one outlet. A valve member is movably supported within the compartment such that movement of the valve member controls the flow rate of fluid from the inlet to the at least one outlet. A user interface is operably coupled to the valve member and supported for rotation relative to the housing, wherein rotation of the user interface causes movement of the valve member.

According to a further illustrative embodiment of the present disclosure, a spray head for use with a faucet includes a housing having an inlet, a first outlet, a second outlet, and a compartment in fluid communication with the inlet and the first and second outlets. A first valve seat is operably coupled to the first outlet, and a second valve seat is operably coupled to the second outlet. A valve plate is configured to sealingly engage the first and second valve seats and is rotatably supported within the compartment. The valve plate includes at least one opening in fluid communication with the inlet and in selective fluid communication with the first and second outlets based upon the rotational position of the valve member. A rotatable stem is operably coupled to the valve plate and extends in a direction outwardly from the housing. A rotatable knob is operably coupled to the stem. A spray face is fluidly coupled to the housing and includes a stream outlet and a plurality of spray outlets surrounding the stream outlet. A spray mode of operation is defined when the valve plate is rotated such that the at least one opening is in fluid communication with the first outlet and a stream mode of operation is defined when the valve plate is rotated such that the at least one opening is in fluid communication with the second outlet.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
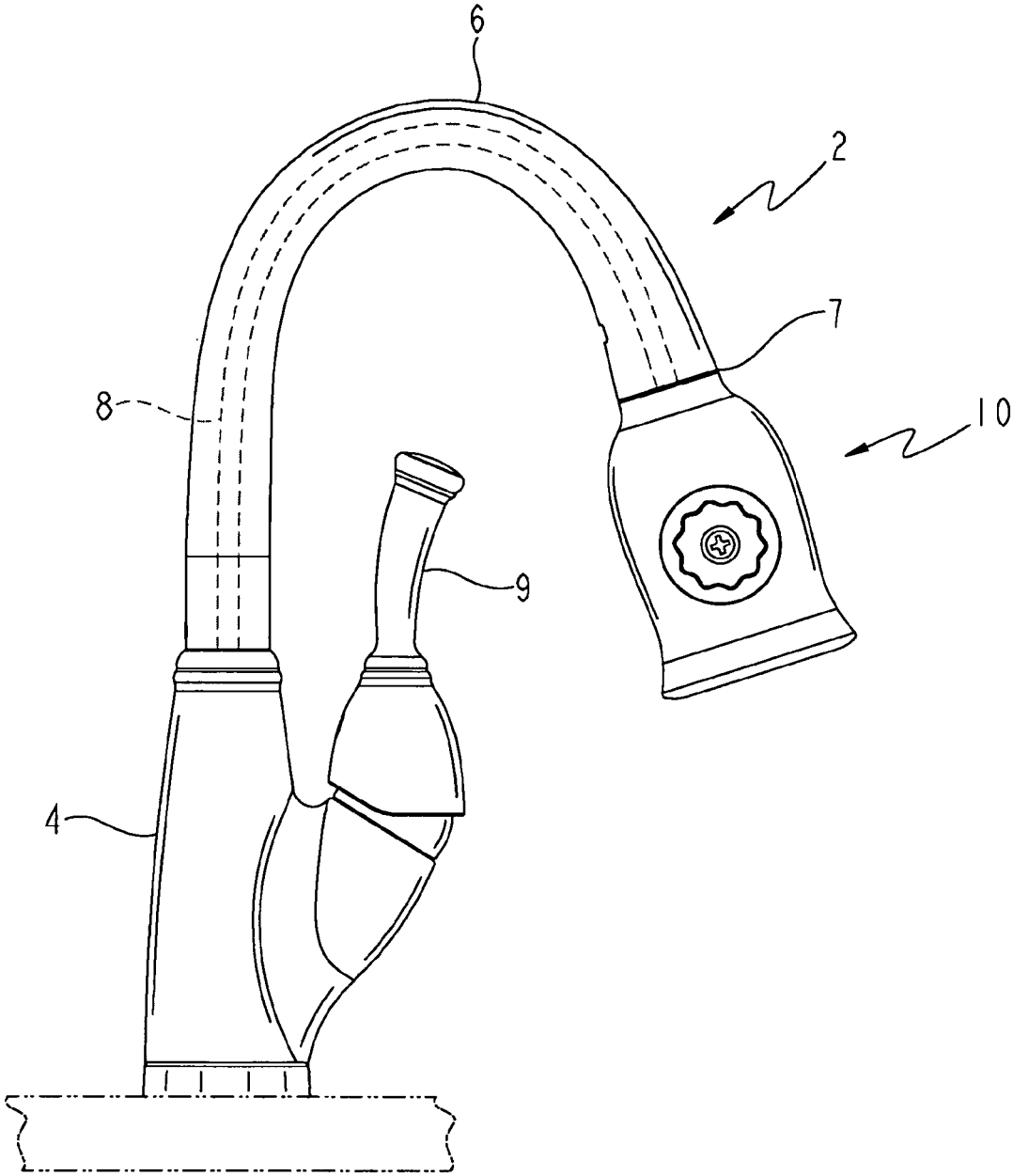
FIG. 1 is a side view of a faucet including a spray head according to an illustrative embodiment of the present invention.

Corresponding reference characters indicate corresponding parts throughout the several views. Although the drawings represent embodiments of the present invention, the drawings are not necessarily to scale and certain features may be exaggerated in order to better illustrate and explain the present invention. Although the exemplification set out herein illustrates embodiments of the invention, in several forms, the embodiments disclosed below are not intended to be exhaustive or to be construed as limiting the scope of the invention to the precise forms disclosed.

DETAILED DESCRIPTION OF THE DRAWINGS

The embodiments hereinafter disclosed are not intended to be exhaustive or limit the invention to the precise forms disclosed in the following description. Rather the embodiments are chosen and described so that others skilled in the art may utilize its teachings.

Referring first to FIGS. 1-5, an illustrative faucet 2 is shown as including a faucet body 4 and a faucet spray head 10 according to one embodiment of the present disclosure. Faucet spray head 10 is adapted to be coupled to body 4, illustratively to a neck or delivery spout 6, of faucet 2 and to be extendable therefrom. More particularly, spray head 10 is removably coupled to an outlet or dispensing end 7 of delivery spout 6 for manipulation independent from body 4. Illustratively, a flexible water conduit 8 extends through spout 6 and is fluidly coupled to a water supply source through a valve, illustratively a conventional mixing valve (not shown) operably coupled to a handle 9. An illustrative embodiment delivery spout 6 which may be used in connection with spray head 10 as described in U.S. patent application Ser. No. 11/325,128, filed Jan. 4, 2006, entitled "Spout Assembly for an Electronic Faucet," the disclosure of which is expressly incorporated by reference herein.

While the following description details spray head 10 removably coupled to delivery spout 6 for illustrative purposes, it should be appreciated that the present invention may find equal applicability with other fluid delivery devices, including side sprayers typically used with kitchen faucets.

Figure 6:
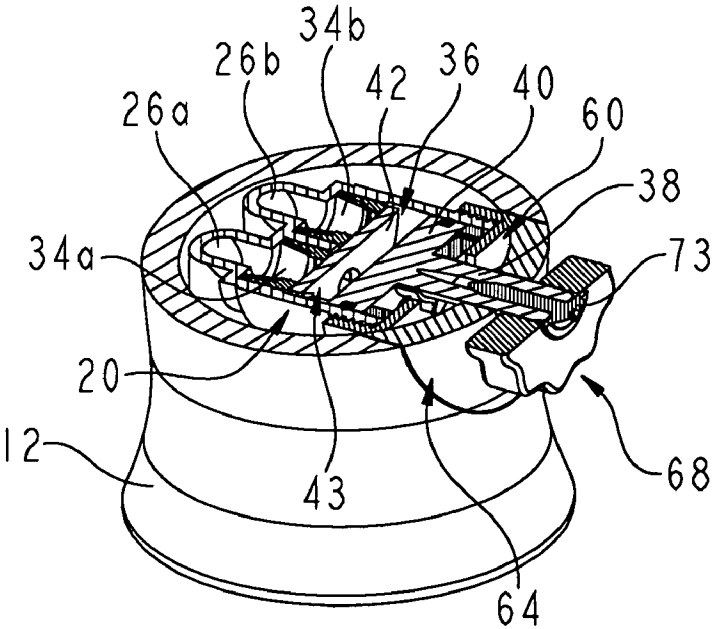
FIG. 6 is a perspective view, in cross-section, of the spray head of FIG. 2.
Figure 5:
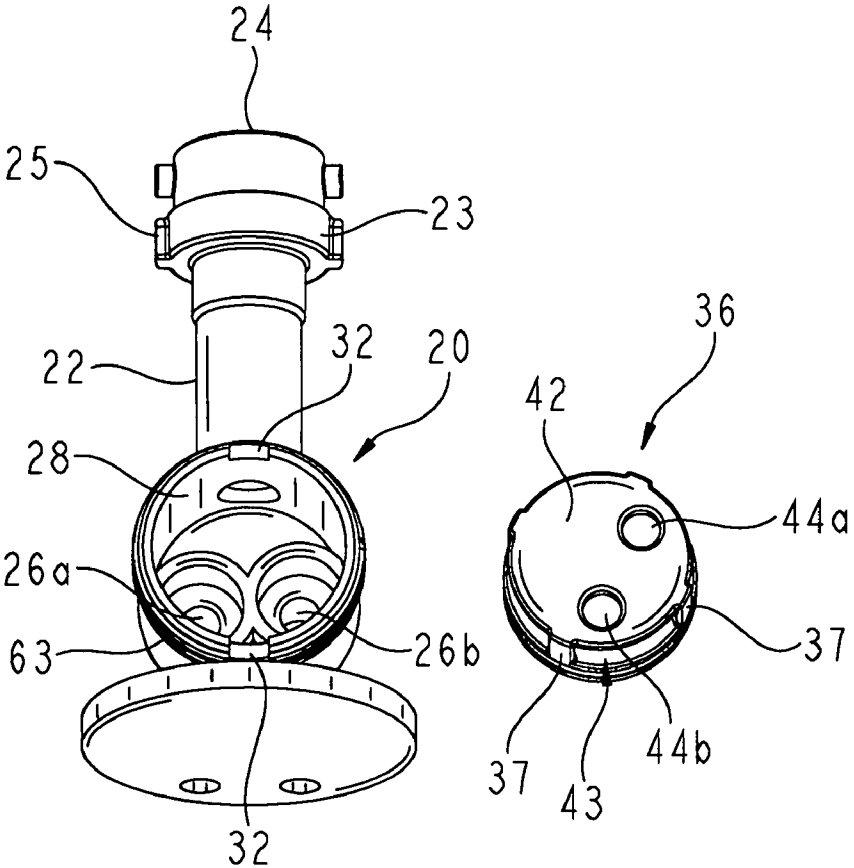
FIG. 5 is a partially exploded perspective view showing the valve member removed from the valve housing of the spray head of FIG. 2.
Figure 7:
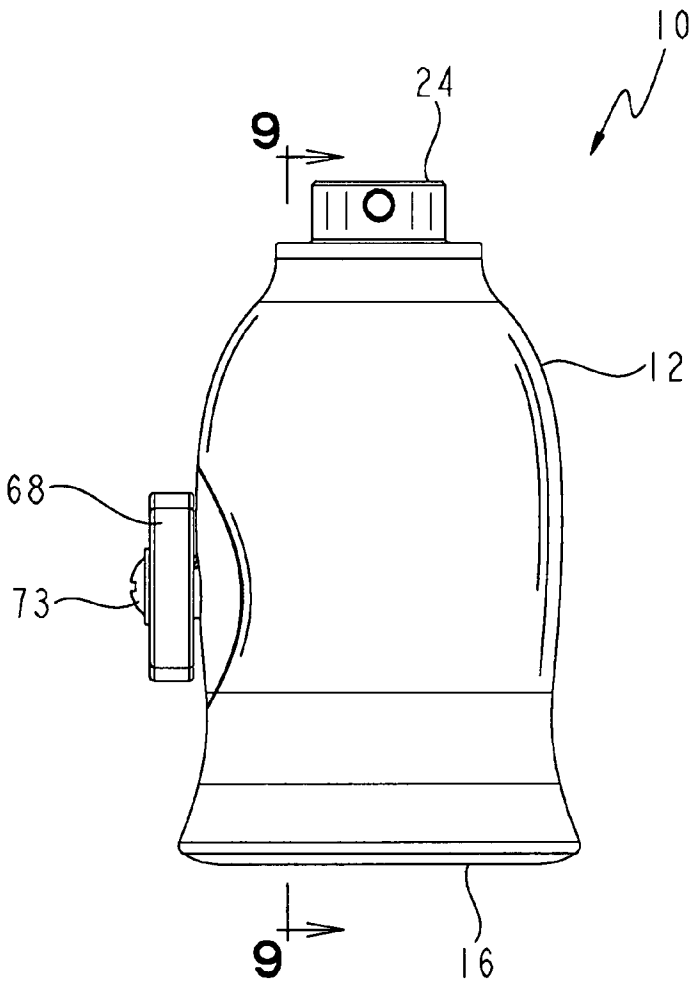
FIG. 7 is another side, assembled view of the spray head of FIG. 2.

With reference to FIGS. 5 and 6, faucet spray head 10 generally includes a shell 12, a valve housing 20 disposed within shell 12, valve seats 34*a*, 34*b* disposed within valve housing 20, a valve member 36 in cooperation with valve seats 34*a*, 34*b*, a rotational limit stop member 48 coupled to valve member 36, a biasing member, illustratively a spring 54 coupled to stop member 48, a bonnet 60 disposed over valve member 36, a cover 64 disposed over bonnet 60, and a dial or knob 68 operably coupled with valve member 36.

Shell 12 defines chamber 13 and includes axially spaced-apart inlet opening 14 and outlet opening 16, both of which are in communication with chamber 13. Inlet opening 14 illustratively includes a pair of diametrically opposed, axially extending grooves 15 positioned therein. Shell 12 also illustratively includes a dial or knob opening 18 extending radially outwardly through a sidewall 19 of shell 12 and in communication with chamber 13. It should be appreciated that the location of the knob opening 18, and thus the location of the knob 68 relative to the shell 12, may vary. Valve housing 20 fits substantially within chamber 13 of shell 12.

Valve housing 20 includes waterway 22 having inlet coupling 23 at one end and first and second outlets 26*a* and 26*b* at the opposite end. Inlet coupling 23 includes inlet 24, which is configured to be attached to a water source, such as a hose (not shown), by way of conventional attachment means, such as threads 27. Projections 25 protrude outwardly from diametrically opposed positions on the perimeter of inlet coupling 23 and are sized to be received in grooves 15 of shell 12. Valve housing 20 defines valve compartment 28 between inlet 24 and outlets 26*a*, 26*b*. Valve housing 20 includes valve compartment opening 30, which is in communication with valve compartment 28 and is aligned with knob opening 18 when valve housing 20 is properly disposed within chamber 13 and projections 25 are received in grooves 15 of shell 12. Compartment opening 30 includes a cylindrical wall 31 having a pair of diametrically opposed notches 32. First and second valve seats 34*a* and 34*b* are housed in compartment opening 30 and are aligned with and coupled to first and second outlets 26*a* and 26*b*, respectively.

Valve member 36 includes a stem 38, a base 40 coupled to one end of stem 38, and a valve plate 42 coupled in a spaced-apart relationship with base 40 by a plurality of connectors 37. A flow control passageway 43 is defined between base 40 and valve plate 42. Stem 38 is substantially cylindrical in shape and defines a central bore 39 extending into the end of stem 38 opposite base 40. A flattened portion 45 is provided on the outer perimeter of stem 38 at the end opposite base 40. First and second openings 44*a* and 44*b* extend through valve plate 42. Base 40 includes a boss 46 extending outwardly therefrom. Valve member 36 is partially disposed within valve compartment 28. More particularly, base 40 and valve plate 42 are disposed in valve compartment 28 while stem 38 protrudes outwardly from compartment 28 and through compartment opening 30 and knob opening 18.

Rotational stop member 48 includes a semi-circular aperture 50 extending therethrough and having end walls 52*a*, 52*b*. Stop member 48 includes a slot 53 extending therethrough and in communication with aperture 50. Diametrically opposed projections 51 extend outwardly from the perimeter of stop member 48 and are sized and configured to be received in notches 32 of valve compartment 28. Stop member 48 seats against base 40 of valve member 36 such that stem 38 and boss 46 extend through aperture 50, and projections 51 are disposed in notches 32.

Figure 9C:
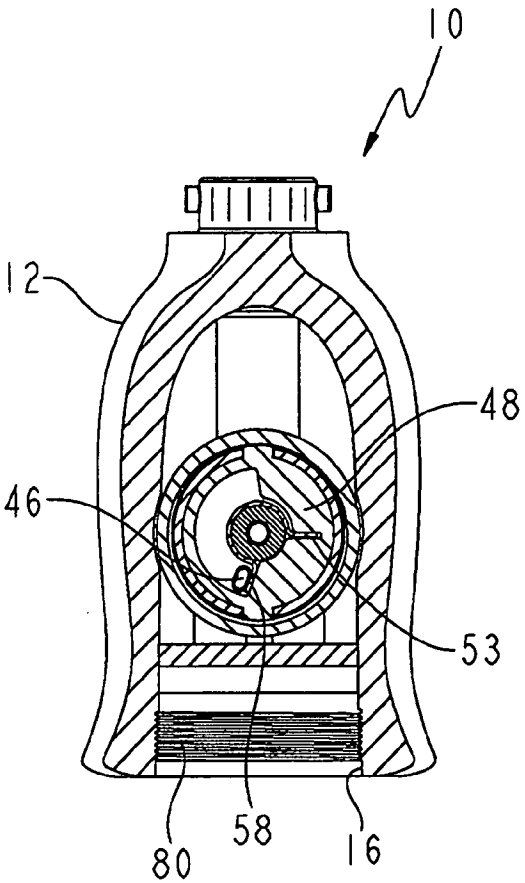
FIG. 9C is a sectional view of the spray head of FIG. 7 taken along line 9-9, wherein the volume control knob is positioned to provide a paused/momentary off mode.
Figure 9B:
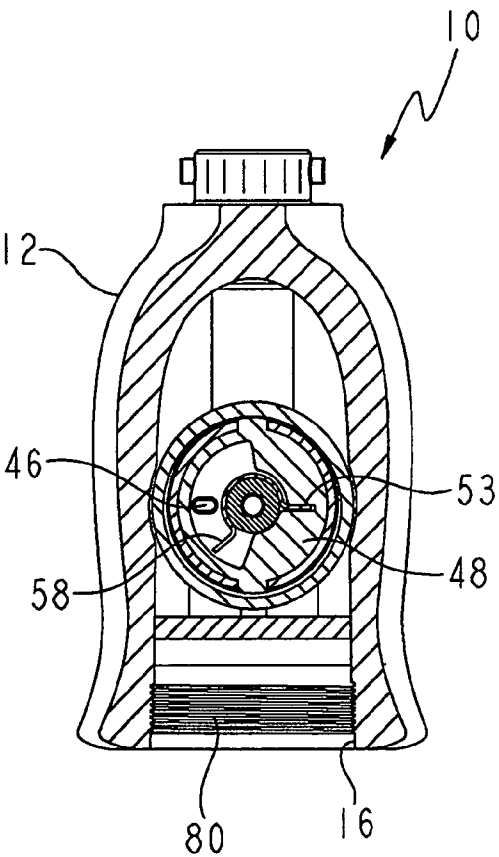
FIG. 9B is a sectional view of the spray head of FIG. 7 taken along line 9-9, wherein the volume control knob is positioned to provide a full stream mode.
Figure 9A:
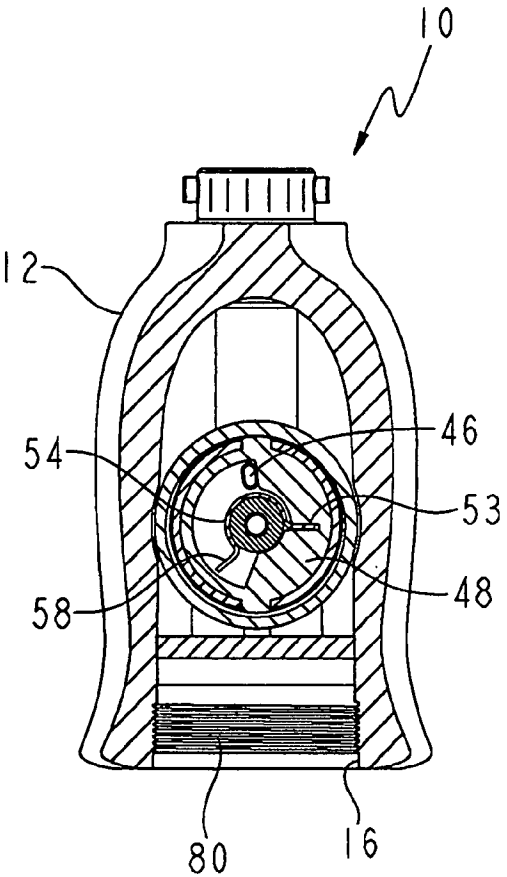
FIG. 9A is a sectional view of the spray head of FIG. 7 taken along line 9-9, wherein the volume control knob is positioned to provide a full spray mode.

Spring 54 is, in part, semi-circular in shape and includes first and second tabbed ends 56, 58 extending from the center semi-circular portion 57 of spring 54. First tab end 56 is coupled to stop member 48, while second tab end 58 is freely supported. More particularly, first tab end 56 is sized to be received in slot 53 of stop member 48, while the semi-circular portion 57 is sized to be disposed in aperture 50 and extend about stem 38 of valve member 36. Second tab end 58 is disposed in aperture 50 as shown in FIGS. 9A-9C.

Figure 2:
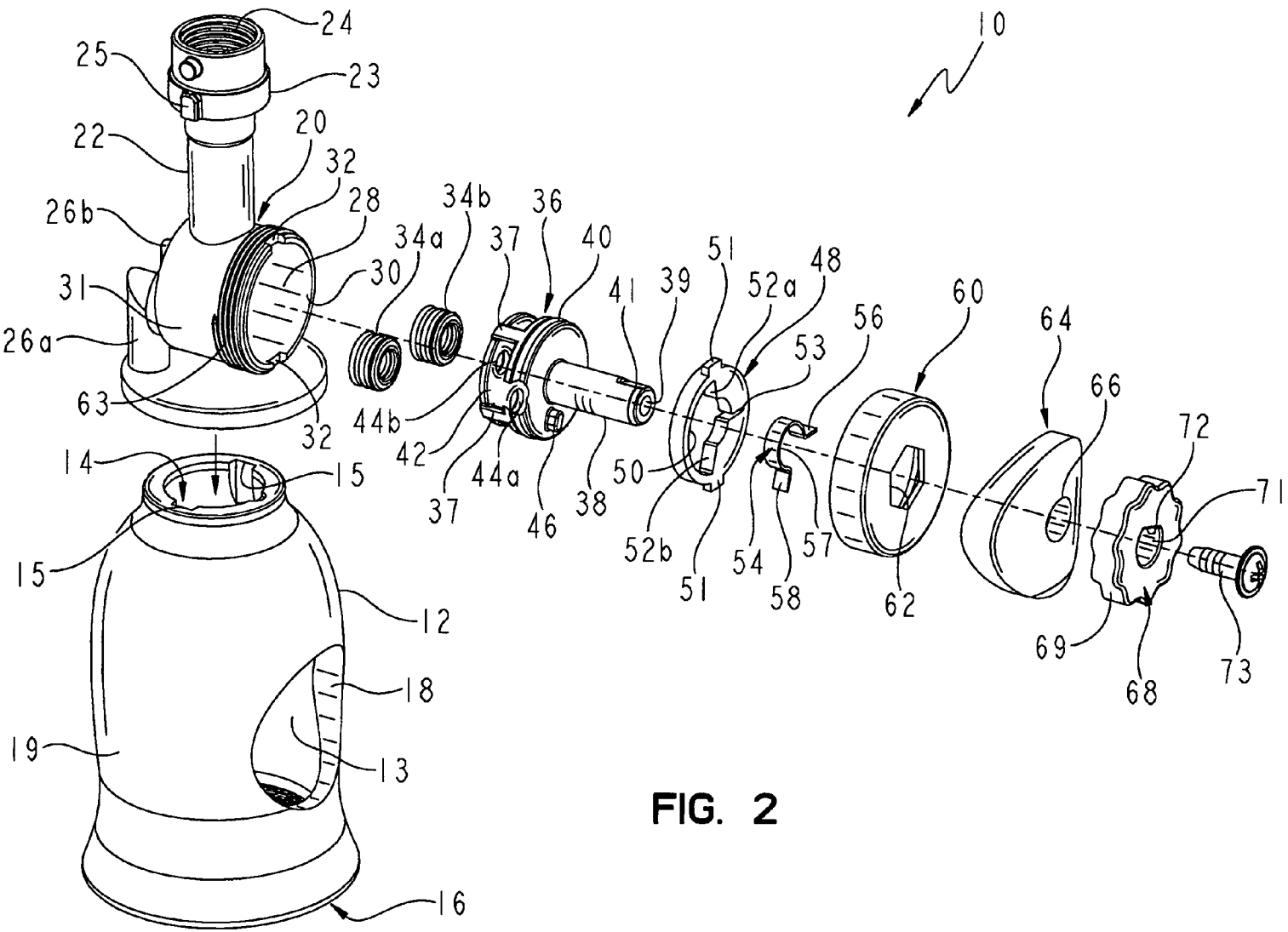
FIG. 2 is an exploded perspective view of the faucet spray head of FIG. 1.
Figure 4:
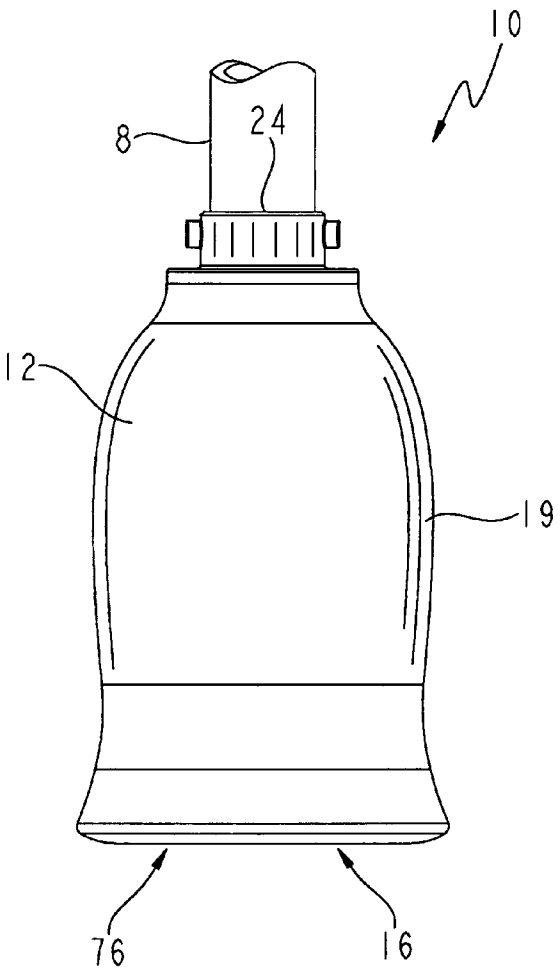
FIG. 4 is a side, assembled view of the spray head of FIG. 2.
Figure 3:
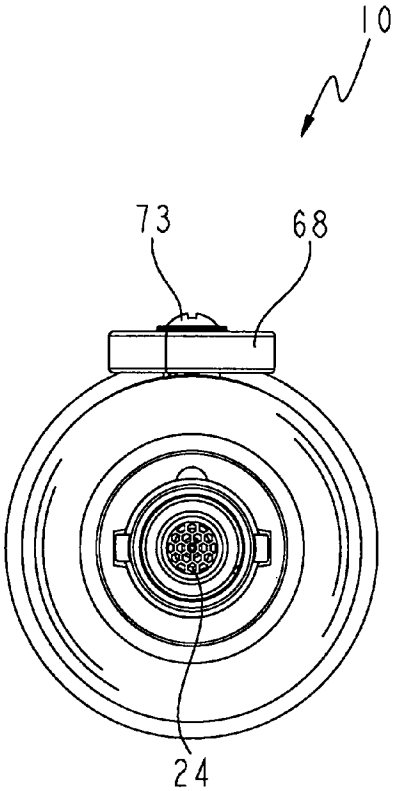
FIG. 3 is a top (inlet) end, assembled view of the spray head of FIG. 2.

Bonnet 60 includes central hole 62. Bonnet 60 is sized and configured to fit through knob opening 18, and to threadably engage external threads 63 formed within wall 31 of valve housing 20. Bonnet 60 extends over spring 54, stop member 48 and base 40, while stem 38 extends through central hole 62. Illustratively, bonnet 60 forces valve plate 42 into sealing engagement within valve seats 34*a* and 34*b*. Cover 64 is contoured to fit within and close knob opening 18. More particularly, cover 64 covers the working parts described above while maintaining the outer shape of sidewall 19 of shell 12. Cover 64 includes central hole 66 through which stem 38 extends (FIGS. 2 and 6).

Knob 68 includes scalloped outer perimeter wall 69 designed to be gripped by the user. A central hole 71 extends through knob 68 and includes a flattened portion 72. The end of stem 38 fits into central hole 71 with flat portions 41 and 72 mating with one another such that rotation of knob 68 induces rotation of stem 38 (and valve member 36) therewith. Screw 73 extends through central hole 71 and engages bore 39 to secure knob 68 to stem 38.

Figure 8:
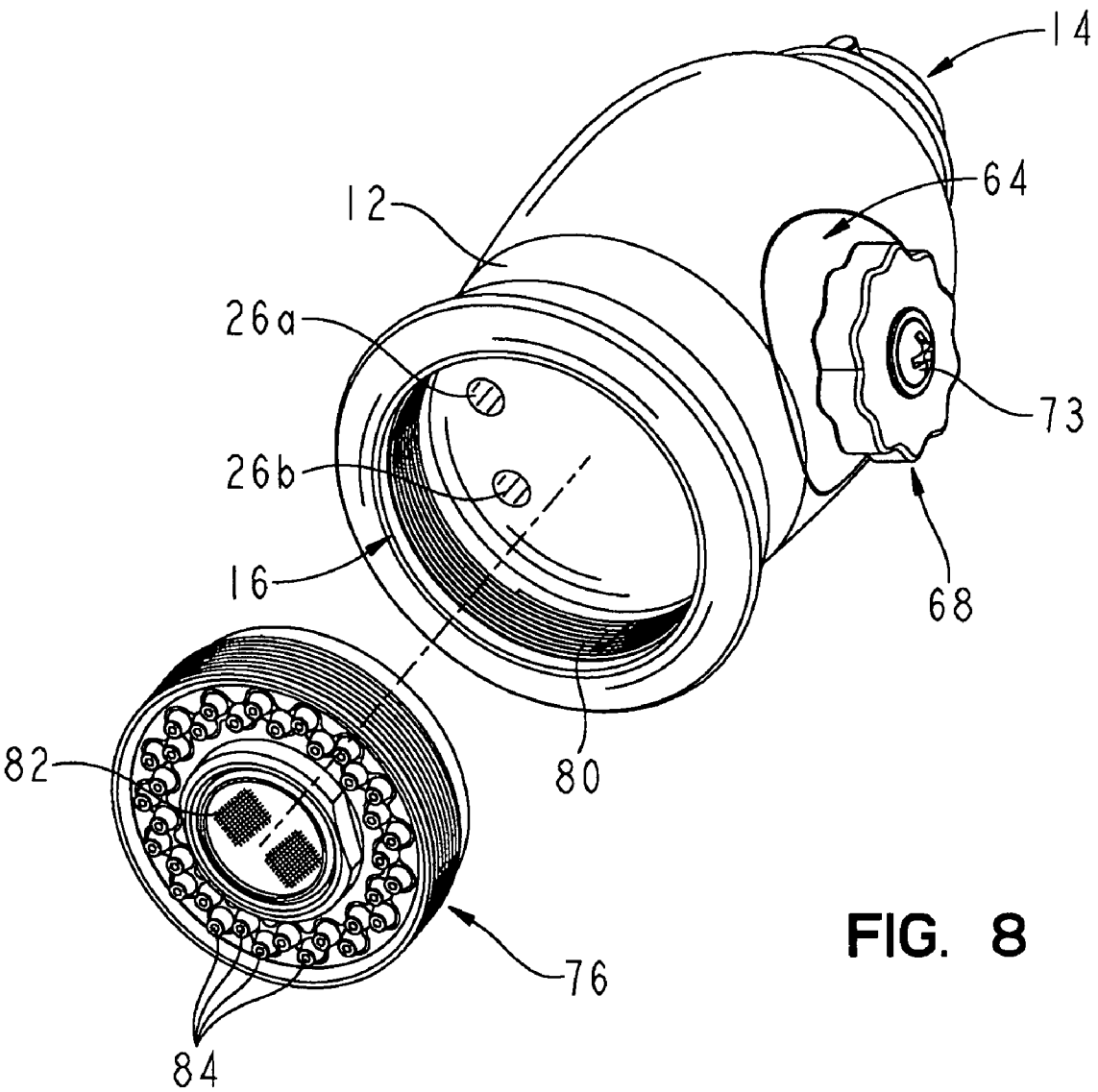
FIG. 8 is a partially exploded view of the spray head of FIG. 2, showing the spray face removed from the shell.

With reference to FIG. 8, a spray face 76 is operably coupled to shell 12. More particularly, spray face 76 includes external threads 78 which engage internal threads 80 formed in outlet opening 16 of shell 12. When properly positioned within shell 12, outlet 26*a* of valve housing 20 is fluidly coupled with a stream outlet 82, illustratively a conventional aerator, supported within the center of the spray face 76.

Similarly, outlet 26*b* of valve housing 20 is fluidly coupled with a plurality of spray outlets 84 arranged in an annular pattern around the stream outlet 82. When fluid flows through outlet 26*a* and out of stream outlet 82, a stream mode of operation is defined. A spray mode of operation is defined when fluid flows through outlet 26*b* and out of spray outlets 84.

Figure 10C:
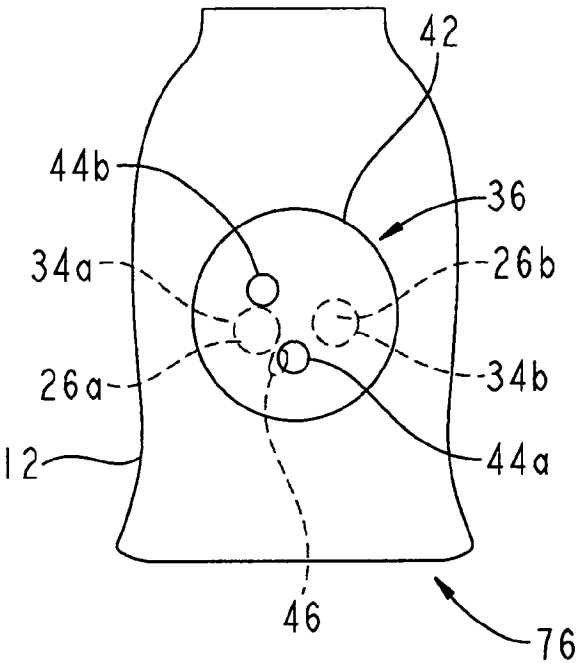
FIG. 10C is a diagrammatic view similar to FIG. 10A showing the position of the valve member relative to the valve housing outlets when the volume control knob is in the position of FIG. 9C.
Figure 10B:
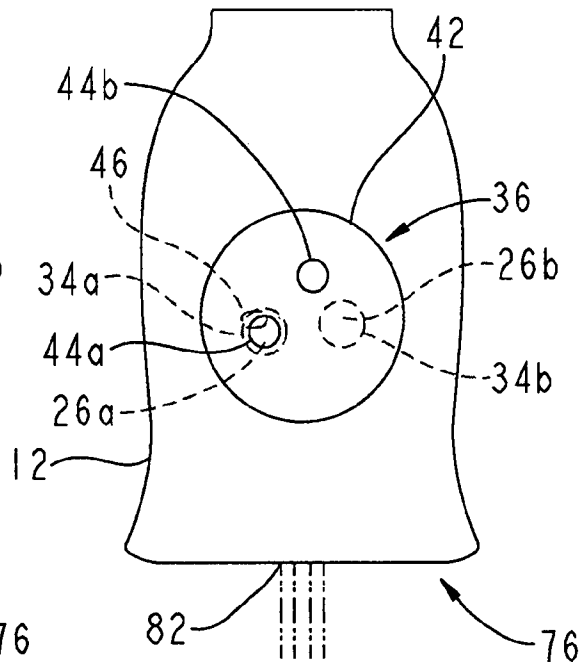
FIG. 10B is a diagrammatic view similar to FIG. 10A showing the position of the valve member relative to the valve housing outlets when the volume control knob is in the position of FIG. 9B.
Figure 10A:
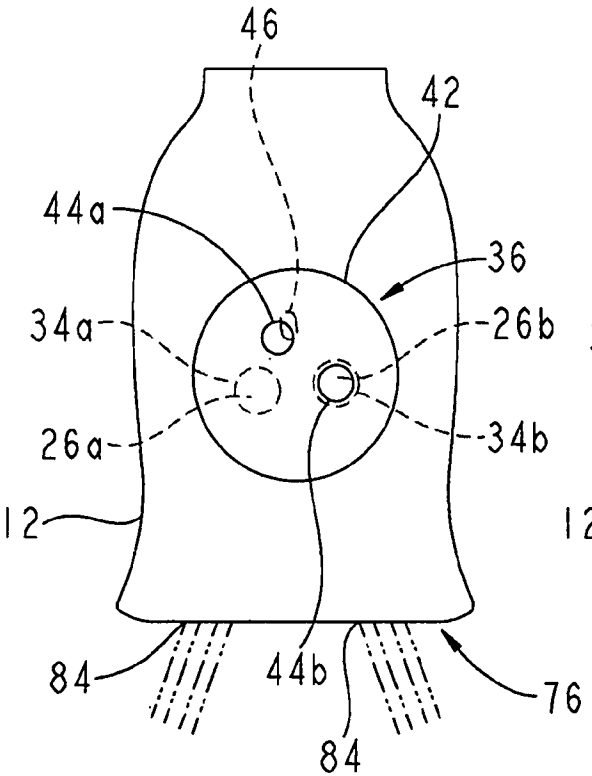
FIG. 10A is a diagrammatic view showing the position of the valve member relative to the valve housing outlets when the volume control knob is in the position of FIG. 9A.

Turning now to FIGS. 2, 7, 9A-9C, and 10A-10C, use of faucet sprayhead 10 will now be described. With the water turned on at the faucet handle 9, water flows through conduit 8 and into waterway 22 via inlet 24. The water then flows into valve compartment 28 and into the control passageway 43 between base 40 and plate 42. When knob 68 defines the full-spray mode of operation, base 40 and boss 46 are in the position shown in FIGS. 9A and 10A. In this mode, valve opening 44*b* is fully aligned with valve seat 34*b*, and water is allowed to flow through opening 44*b*, valve seat 34*b* and into outlet 26*b*. Water is then discharged in full spray flow through spray outlets 84 of spray face 76 supported within outlet opening 16 of faucet spray head 10, as shown in FIG. 10A.

When knob 68 is moved to the full-stream position, base 40 and boss 46 are rotated counter-clockwise to the position shown in FIGS. 9B and 10B. In this position, valve opening 44*a* is fully aligned with valve seat 34*a* and water is allowed to flow through opening 44*a*, valve seat 34*a* and into outlet 26*a*. Water is then discharged through stream outlet 82 of spray face 76 supported within outlet opening 16, as shown in FIG. 10B.

As may be appreciated, rotation of base 40 and valve plate 42 alters the portions of valve openings 44*a* and 44*b* in fluid communication with either valve seat 34*a* or 34*b* and, hence, outlets 26*a* or 26*b*. As such, rotation of knob 68 controls not only the type or mode of flow operation (spray or stream) but the level or rate of water flow (i.e. volume control) in a continuously variable manner. More particularly, as knob 68 is rotated from the full-spray mode to the full-stream mode, flow through valve seat 34*b* and corresponding outlet 26*b* is gradually reduced by valve opening 44*b*, while flow through valve seat 34*a* and corresponding outlet 26*a* is gradually increased.

When knob 68 is turned to the momentary off or paused position, base 40 and boss 46 are rotated counter-clockwise to the position shown in FIGS. 9C and 10C. In this position, openings 44*a* and 44*b* are not aligned with either of valve seats 34*a* and 34*b*. Therefore, plate 42 blocks water from flowing through seats 34*a*, 34*b* and outlets 26*a*, 26*b*, thereby shutting off the water. Further, in this position, boss 46 engages second tab 58 of spring 54 and forces it to end wall 52*b* of stop member 48. In this position, spring 54 is compressed such that, when user releases grip on knob 68, spring 54 forces boss 46 away from end wall 52*b*, thereby rotating base 40 such that opening 44 is at least partially aligned with either of valve seats 34*a*, 34*b*. Water is then free to flow through the aligned one of valve seats 34*a*, 34*b* and corresponding outlets 26*a*, 26*b*.

Spring 54 prevents plate 42 from being inadvertently left in the off position thereby avoiding the mixing or backing up of hot water into the cold water supply. Accordingly, the user must consciously maintain knob 68 in the off position in order to pause the water flow.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

The invention claimed is:

1. A faucet comprising:

a delivery spout including an outlet; and a pull-out spray head fluidly coupled to a flexible water conduit extending through the delivery spout, and removably coupled to the outlet of the delivery spout, the spray head including a valve housing having an inlet, an outlet, and a compartment positioned intermediate, and in fluid communication with, the inlet and the outlet, a volume control movably supported within the compartment for providing continuous variable adjustment of fluid flow rate between the inlet and the outlet from a low flow to a high flow, the volume control configured to be set and maintained in a first position relative to the valve housing to provide the low flow, in a second position relative to the valve housing to provide the high flow, and in a plurality of positions intermediate the first position and the second position to provide fluid flow rates intermediate the low flow and the high flow, the volume control including a rotatable valve member having at least one opening in fluid communication with the inlet and in selective communication with the outlet, the valve member including a rotatable valve plate having at least one opening, the outlet including a first outlet and a second outlet spaced from the first outlet, wherein rotation of the valve plate such that the at least one opening is in fluid communication with the first outlet defines a stream mode of operation, and rotation of the valve plate such that the at least one opening is in fluid communication with the second outlet defines a spray mode of operation.

2. The faucet of claim 1, wherein the volume control is further configured to provide a stream mode of operation and a spray mode of operation.

3. The faucet of claim 1, wherein the volume control includes a rotatable knob operably coupled to the valve member.

4. The faucet of claim 1, further comprising a stop member operably coupled to the valve member and defining upper and lower limits for rotation of the valve member.

5. The faucet of claim 1, wherein the volume control is movable to a momentary off position for preventing fluid flow from the inlet to the outlet.

6. The faucet of claim 5, further comprising a biasing member operably coupled to the volume control and configured to bias the volume control away from the momentary off position.

7. The faucet of claim 6, wherein the biasing member comprises a spring.

8. The faucet of claim 1, further comprising a valve positioned upstream from the spray head and configured to control water flow to the volume control.

9. A spray head for use with a faucet, the spray head comprising:

a housing including an inlet, a first outlet, and a second outlet, wherein fluid flow through the first outlet defines a first mode of operation, and fluid flow through the second outlet defines a second mode of operation;

a control interface supported by the housing, wherein the same actuating movement of the control interface simultaneously selects at least one of the first mode of operation through the first outlet and the second mode of operation through the second outlet, and the rate of fluid flow from a low flow to a high flow through at least one of the first and second outlets in the selected mode of operation;

a valve member operably coupled to the control interface and supported within the housing, the valve member including at least one opening in fluid communication with the inlet and in selective communication with the first and second outlets; and wherein rotation of the valve member to a first angular position causes the at least one opening to be in fluid communication with the first outlet for defining the first mode of operation, rotation of the valve member to a second angular position beyond the first angular position causes the at least one opening to be in fluid communication with the second outlet for defining the second mode of operation, and the rate of fluid flow varies as the valve member is rotated from the first angular position to the second angular position.

10. The spray head of claim 9, wherein actuation of the control interface provides for continuous variable adjustment of fluid flow rate from the low flow to the high flow.

11. The spray head of claim 9, wherein the control interface includes a rotatable knob operably coupled to the valve member.

12. The spray head of claim 9, further comprising a stop member operably coupled to the valve member and defining upper and lower limits for rotation of the valve member.

13. The spray head of claim 9, wherein the housing is removably coupled to a delivery spout of a faucet.

14. The spray head of claim 9, wherein a valve is positioned upstream from the housing and is configured to control the flow of fluid to the inlet.

15. The spray head of claim 9, wherein the first mode of operation comprises a spray mode, and the second mode of operation comprises a stream mode.

16. A spray head for use with a faucet, the spray head comprising:

a housing including an inlet, a first outlet, a second outlet, and a compartment in fluid communication with the inlet and the first and second outlets, wherein fluid flow through the first outlet defines a spray mode of operation, and fluid flow through the second outlet defines a stream mode of operation;

a valve member movably supported within the compartment upstream from the first and second outlets, the valve member including a rotatable valve plate having at least one opening alignable with the first outlet in a first angular position and alignable with the second outlet in a second angular position, such that rotation of the valve plate intermediate the first and second angular positions further controls the flow rate of fluid from the inlet to at least one of the first and second outlets; and a user interface operably coupled to the valve member and supported for rotation relative to the housing, wherein rotation of the user interface causes rotation of the valve plate to adjust the flow rate of fluid supplied to the first outlet in the spray mode of operation and to the second outlet in the stream mode of operation.

17. The spray head of claim 16, wherein the user interface includes a rotatable knob operably coupled to the valve member.

18. The spray head of claim 16, further comprising a stop member operably coupled to the valve member and defining upper and lower limits for rotation of the valve member.

19. The spray head of claim 16, wherein the valve member is rotatable to a momentary off position for preventing fluid flow from the inlet to either of the first and the second outlets.

20. The spray head of claim 19, further comprising a biasing member operably coupled to the volume control and configured to bias the volume control away from the momentary off position.

21. A spray head for use with a faucet, the spray head comprising:

a housing including an inlet, a first outlet, a second outlet, and a compartment in fluid communication with the inlet and the first and second outlets;

a first valve seat operably coupled to the first outlet;

a second valve seat operably coupled to the second outlet;

a valve plate positioned upstream of the first and second outlets of the housing, the valve plate configured to sealingly engage the first and second valve seats and rotatably supported within the compartment, the valve plate including at least one opening in fluid communication with the inlet and in selective fluid communication with the first and second outlets based upon the rotational position of the valve member;

a rotatable stem operably coupled to the valve plate and extending in a direction outwardly from the housing;

a rotatable knob operably coupled to the stem; and a spray face fluidly coupled to the housing and including a stream outlet in fluid communication with the second outlet of the housing and a plurality of spray outlets in fluid communication with the first outlet of the housing and surrounding the stream outlet, wherein a spray mode of operation is defined when the valve plate is rotated to a first angular position such that the at least one opening is in fluid communication with the first outlet of the housing and a stream mode of operation is defined when the valve plate is rotated to a second angular position such that the at least one opening is in fluid communication with the second outlet of the housing.

22. A faucet comprising:

a delivery spout including an outlet; and a pull-out spray head fluidly coupled to a flexible water conduit extending through the delivery spout, and removably coupled to the outlet of the delivery spout, the spray head including a valve housing having an inlet, an outlet, and a compartment positioned intermediate, and in fluid communication with, the inlet and the outlet, a volume control movably supported within the compartment for providing continuous variable adjustment of fluid flow rate between the inlet and the outlet from a low flow to a high flow, the volume control configured to be set and maintained in a first position relative to the valve housing to provide the low flow, in a second position relative to the valve housing to provide the high flow, and in a plurality of positions intermediate the first position and the second position to provide fluid flow rates intermediate the low flow and the high flow, the volume control including a rotatable valve member including at least one opening in fluid communication with the inlet and in selective communication with the outlet, and a rotatable knob operably coupled to the valve member, and wherein the knob rotates about an axis extending substantially perpendicular to a longitudinal axis of the valve housing.

23. The spray head of claim 9, wherein rotation of the valve member to a third angular position beyond the second angular position causes the first and second outlets to be blocked from fluid communication with the at least one outlet of the valve member such that the valve member is in an off mode of operation.

24. The spray head of claim 23, further comprising a biasing member operably coupled to the valve member and configured to bias the valve member away from the third angular position toward the second angular position.

25. The spray head of claim 11, wherein the knob rotates about an axis extending substantially perpendicular to a longitudinal axis of the housing.

26. The spray head of claim 17, wherein the knob rotates about an axis extending substantially perpendicular to a longitudinal axis of the housing.

27. The spray head of claim 21, wherein rotation of the valve plate to a third angular position beyond the second angular position causes the first and second outlets to be blocked from fluid communication with the at least one outlet of the valve plate such that the valve plate is in an off mode of operation.

28. The spray head of claim 27, further comprising a biasing member operably coupled to the valve plate and configured to bias the valve plate away from the third angular position toward the second angular position.

29. The faucet of claim 21, wherein the knob rotates about an axis extending substantially perpendicular to a longitudinal axis of the valve housing.

30. The faucet of claim 22, wherein the volume control is further configured to provide a stream mode of operation and a spray mode of operation.

31. The faucet of claim 22, further comprising a stop member operably coupled to the valve member and defining upper and lower limits for rotation of the valve member.

32. The faucet of claim 22, wherein the volume control is movable to a momentary off position for preventing fluid flow from the inlet to the outlet.

33. The faucet of claim 32 further comprising a biasing member operably coupled to the volume control and configured to bias the volume control away from the momentary off position.

34. The faucet of claim 33, wherein the biasing member comprises a spring.

35. The faucet of claim 22, further comprising a valve positioned upstream from the spray head and configured to control water flow to the volume control.

* * * * *